US006443081B1

(12) United States Patent
Quint

(10) Patent No.: US 6,443,081 B1
(45) Date of Patent: Sep. 3, 2002

(54) APPLIQUE ART KIT ASSEMBLY AND METHOD OF CREATING AN APPLIQUE ART OBJECT

(76) Inventor: Laura J. Quint, P.O. Box 291, 317 N. Main, Buhler, KS (US) 67522

( * ) Notice: Subject to any disclaimer, the term of this patent is extended or adjusted under 35 U.S.C. 154(b) by 104 days.

(21) Appl. No.: 09/689,979

(22) Filed: Oct. 13, 2000

(51) Int. Cl.[7] ..... D05B 97/00; D05C 17/00

(52) U.S. Cl. ..... 112/475.18; 112/439

(58) Field of Search ..... 112/475.18, 103, 112/439, 441, 117, 475.21, 475.22

(56) References Cited

U.S. PATENT DOCUMENTS 4,634,616 A * 1/1987 Musante et al. ..... 112/475.18
4,646,666 A * 3/1987 Burrier ..... 112/420
4,814,218 A * 3/1989 Shane ..... 112/475.18
5,531,176 A * 7/1996 Johnson ..... 112/439

* cited by examiner

*Primary Examiner*—Ismael Izaguirre

(57) ABSTRACT

The appliqué assembly kit incorporates pressure sensitive self-adhesive reusable pre-cut, pre-printed vinyl appliqué templates stored on a silicone-coated support member plus a clear pre-printed overlay(s) member for placement. Said templates are peeled from liner and adhered with hand pressure to right side of applique material. Material is cut with desired seam allowance around peripheral edge of adhered template. With use of said overlay, template/appliqué material unit is positioned onto right side of background material. Overlay is lifted away and template/appliqué material unit is secured to the background material by using pins or water-based glue. Seam allowance, around peripheral edge of adhered template, is needle turned under and stitched onto background material using template as a guide. Once sewn, template is peeled away from material and returned to silicone-coated member for future use. The above steps are repeated with each template until all pieces are sewn into position.

20 Claims, 4 Drawing Sheets

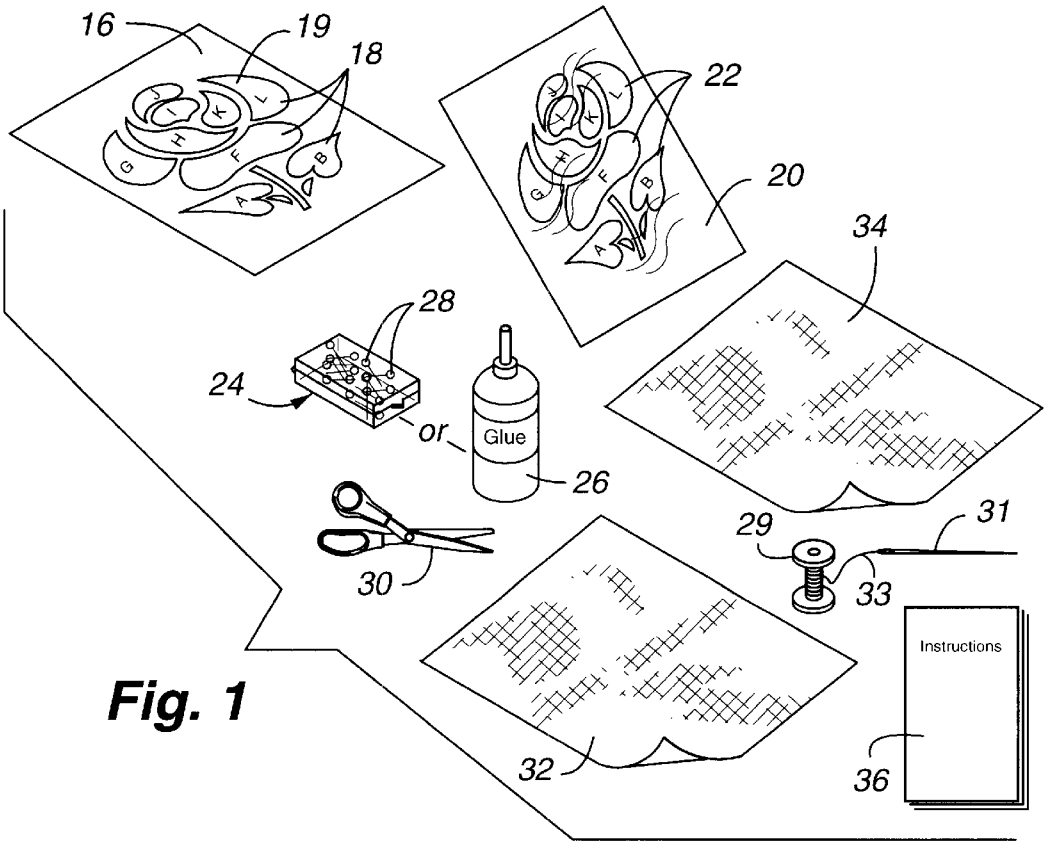
Fig. 1
Fig. 2
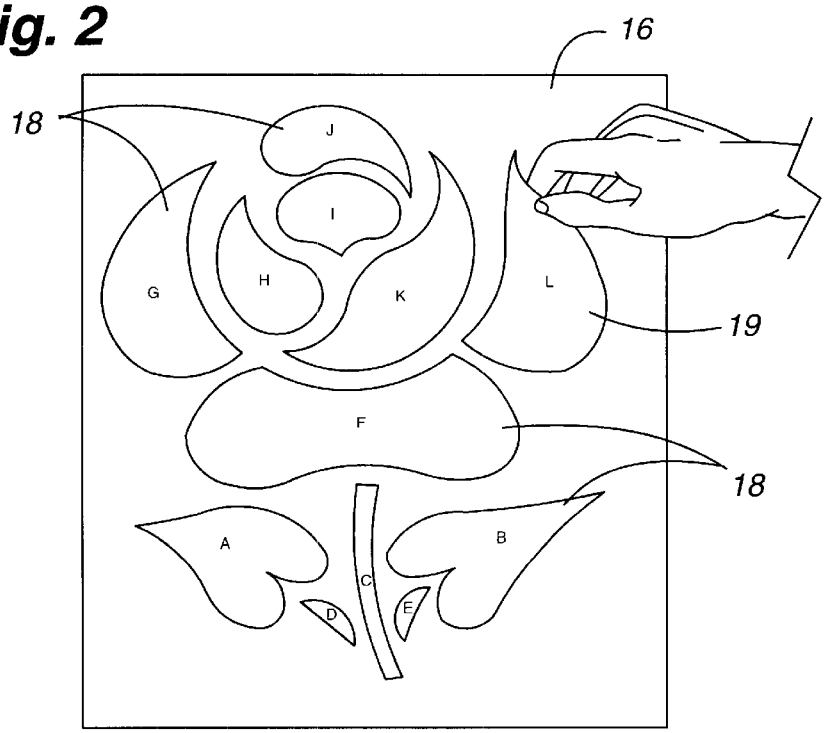

Fig. 7
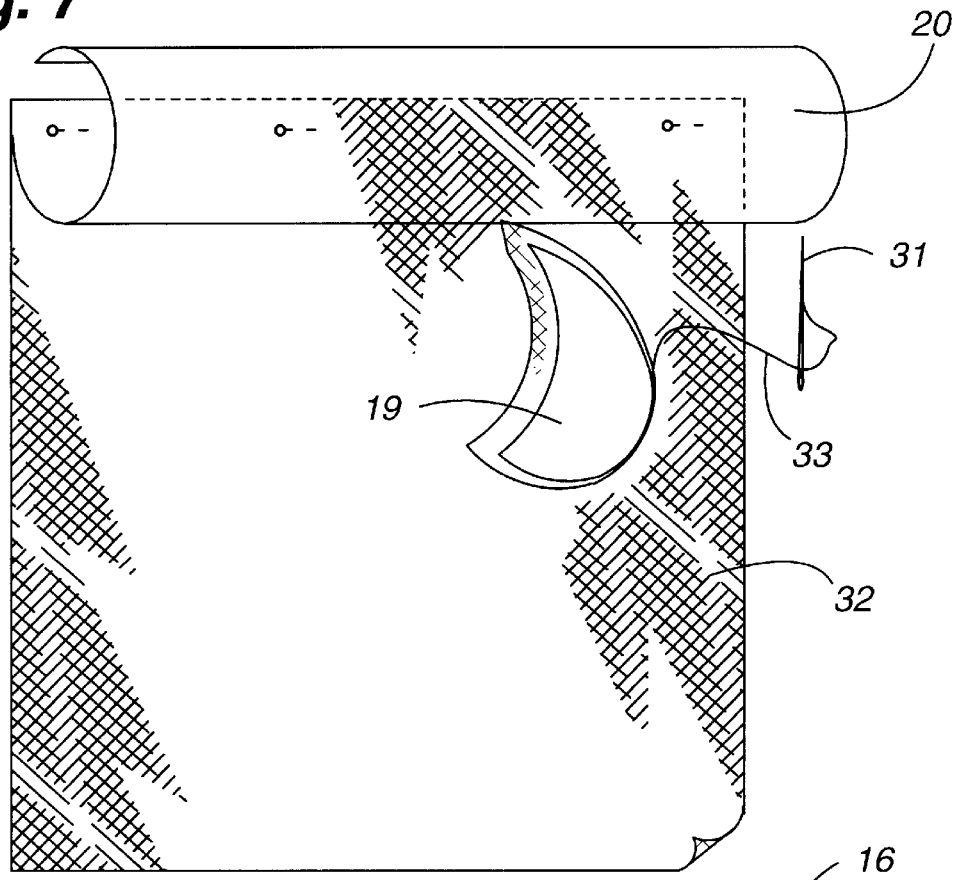
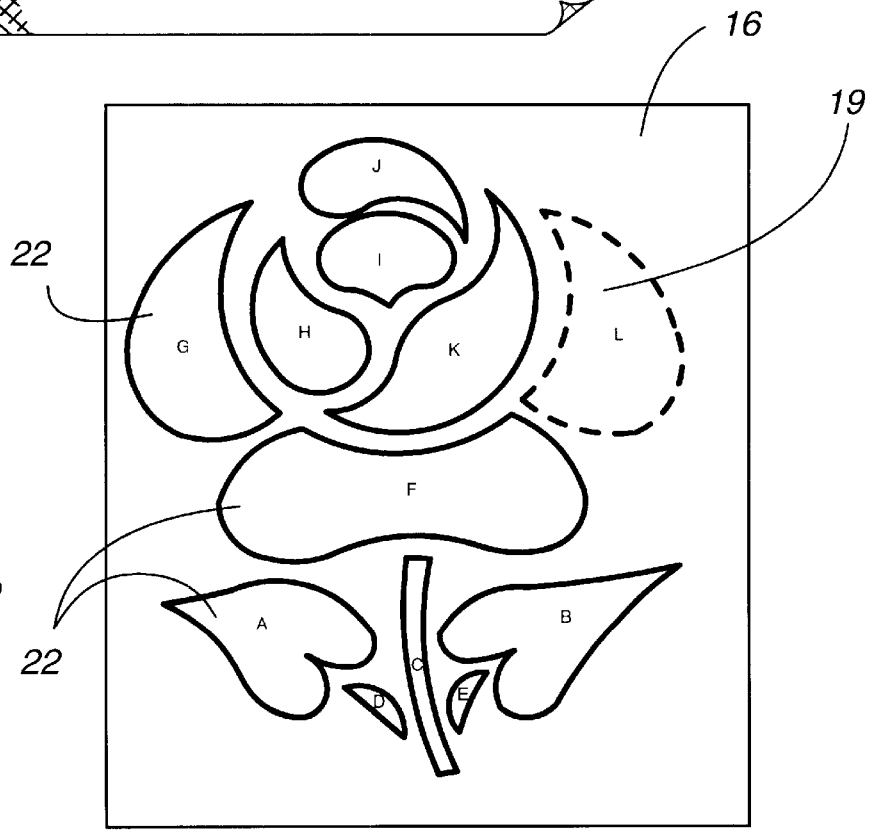
Fig. 8

APPLIQUE ART KIT ASSEMBLY AND METHOD OF CREATING AN APPLIQUE ART OBJECT

PRIOR ART

The following prior art patent is noted:

| Pat. No. | INVENTION | INVENTOR |
|---|---|---|
| 5,531,176 | METHOD OF MAKING AN APPLIQUE | Adrienne M. Johnson |

The Johnson patent describes a method of making an applique art object, however this prior art method requires applique elements to be cut from a sheet of applique material and subject patent does not have many of the new and novel features of the applicant's invention as set forth hereinafter.

PREFERRED EMBODIMENT OF THE INVENTION

In one preferred embodiment of this invention, an applique art kit assembly and method of creating applique art is provided which is simple to use and has easy steps for creating the applique final product, being an applique art object.

The applique art kit assembly is provided having all of the elements and instructions therein to proceed with creating a specific final applique art object that can be put in any textile art such as quilts, clothing, or other such suitable uses.

The applique art kit assembly includes 1) a silicone coated liner support member having applique elements or templates, which are preferably pre-cut and pre-printed, releasably connected thereto and presented thereon in an image of the applique art object; 2) an overlay sheet member of a clear material having thereon an image outline of the applique art object; 3) a box of anchor pins or a fabric squeeze bottle of glue; 4) a pair of scissor members to cut cloth material as will be described; 5) a spool of thread used with a needle member; 6) a yardage of background material; 7) a yardage of cloth applique material; and 8) an instruction sheet with instructions on how to proceed to produce the applique art object.

The applique art kit assembly may be marketed with only 1) the silicone coated liner support member having the applique elements or templates, 2) the overlay sheet member, and 3) the instruction sheet. In this case, the purchaser or consumer would provide 1) the box of anchor pins or a fabric squeeze bottle of glue; 2) the pair of scissor members; 3) the spool of thread used with the needle member; 4) the yardage of background material; and 5) the yardage of cloth applique material.

The silicone coated liner support member is provided with a plurality of pre-cut vinyl applique elements or templates thereon which, together, presents a final applique art object such as the outline of a bird, a fish, a rose, or the like and the applique elements or templates would normally be numbered such as by respective letters A–L printed thereon or the like.

The overlay sheet member is of a clear material such as vinyl material having printed applique element images or outlines thereon to conform to the final applique art object to be created, such as a bird or rose outline.

The box of anchor pins contain a plurality of pin members therein for anchoring the various applique elements or templates to the yardage of background material as will be noted. The anchor pins can be replaced by fabric glue in order to glue the applique material to the consumer chosen yardage of background material as will be explained. Next, the scissor members are of a conventional nature in order to cut the cloth of the applique material to which the applique templates are attached by hand pressure to cause an attachment thereof.

The spool of thread in combination with the needle member is operable in order to sew the applique material to the consumer chosen yardage of background material as will be explained.

The consumer chosen yardage of background material is normally of a cloth material to which the applique templates is to be attached. The consumer chosen yardage of applique material may be of various colors so as to create the final applique art having various colors thereon to complete the desired art work.

The instruction sheet is of a conventional nature having instructions therein for a step-by-step method of creating an applique art object from the elements presented in the applique art kit assembly.

The method of creating the applique art object from the applique art kit assembly consists mainly of the following steps:

1. removing a pre-cut, pre-printed applique template from the silicone coated liner support member with the applique template having a pressure sensitive adhesive on a back side thereof;
2. applying the removed applique template to the face side of the yardage of applique material that sticks thereto because of pressure sensitive adhesive on the back side thereof;
3. pressing down on the applique template against the face side of the applique template material with hand pressure to cause an attachment thereof;
4. cutting the yardage of applique material about the applique template, leaving approximately ¼ of an inch margin on an outer edge of the applique template;
5. connecting the clear vinyl overlay sheet member along one edge to the chosen yardage of background material as by the pin members;
6. lifting the overlay sheet member upwardly to be pivoted about the pin members away from the background material;
7. placing the applique template, attached to the applique material, in a proper position relative to the image outline of the applique art object to be created as shown on the overlay sheet material and pinned or glued in place;
8. turning under the ¼ of an inch margin and sewing the applique template material to the chosen yardage of background material in a proper location as indicated on the overlay sheet member with its printed applique images or outlines thereon;
9. after completion of the sewing of the applique material to the chosen yardage of background material, remove the vinyl applique template from the sewn applique material;
10. return the removed applique template to the silicone coated liner support member for future use thereof; and
11. repeat the above 1–10 steps until the applique art object is finally completed.

The completed applique art object thereby represents an artistic design created by various colors of the applique material mounted on the chosen yardage of background material to present the artistic design of a butterfly, bird, rose, or other designs thereon. The completed applique art object can then be sewn into a quilt, wall hanging, garment, or the like.

OBJECTS OF THE INVENTION

One object of this invention is to provide an applique art kit assembly having all elements therein for ease of creating an applique art object with a minimum amount of effort, time, and skill required in order to create and finalize a unique applique art object.

Another object of this invention is to provide an applique art kit assembly not requiring a light box, copy machine, tracing or cutting out of various elements of applique art from a sheet of wax coated paper, or having to utilize a hot iron method with an electrical power source of attaching the applique art element to a background material.

One further object of this invention is to provide a method of creating an applique art object having a plurality of easy to follow method steps with pre-cut and pre-printed vinyl applique templates utilized having a pressure sensitive adhesive on back sides thereof that can be applied to an applique material and cut about an outer peripheral edge, which is then applied and sewn to a chosen yardage of background material in light of a clear vinyl overlay sheet member having printed thereon a plurality of applique element images or outlines so that the user thereof places the applique templates in a proper position to create a final image such as a bird, parrot, or rose outline to create the final applique art object.

Another object of this invention is to provide a method of creating an applique art object in a step-by-step procedure which assures that the final product is created without any placement errors due to easy to follow, simple method steps as set forth in an instruction sheet supplied therewith.

One further object of this invention is to provide a method of creating an applique art object without the need of creating fabric art elements with a light box; without a need of tracing the shapes of the applique art elements onto fabric; without tracing the applique art elements onto any rigid substance such as paper, card stock, or a plastic template member; and without use of an electrical iron to adhere the applique art element to a background material.

Still, one other object of this invention is to provide a method of creating an applique art object wherein a liner support member having a plurality of pre-cut and pre-printed sheets of vinyl applique templates each having a pressure sensitive adhesive applied to one side thereof; the pre-cut and pre-printed applique templates can be removed from the liner support member and placed on a face side of an applique material and adhering thereto by pressing down with hand pressure; with the use of a cutting means or scissors, the applique material is trimmed preferably ¼ of an inch from an outer peripheral edge of the applique template; the applique template material that has been cut to the shape of the applique template now positioned on a face side of the chosen yardage of background material and connected as by being pinned or glued into place; the applique material is now turned under the ¼ of an inch and sewn to the yardage of background material, using a threaded needle in a pre-selected stitch; once the completed applique material is sewn to the chosen yardage of background material, the vinyl applique template can be removed from the applique material and placed back on the silicone coated liner support member for future use as so desired; and the above noted method steps are repeated to add other applique templates and applique material to the chosen yardage of background material to create the applique art object.

Various other objects, advantages, and features of the invention will become apparent to those skilled in the art from the following discussion, taken in conjunction with the accompanying drawings, in which:

FIGURES OF THE INVENTION

FIG. 1 is a perspective view of all necessary elements to form an applique art kit assembly of this invention wherein the consumer may provide pins or glue, chosen background material, and multiple chosen applique material;

FIG. 2 is a top plan view of a silicone coated liner support member having a plurality of pre-cut and pre-printed vinyl applique elements or templates mounted thereon in a pre-selected order so as to include all elements of a rose member;

FIG. 7 is a view similar to FIG. 6 but having the overlay sheet member being unpinned, raised and removed, and the applique template material is shown as being sewn to the chosen yardage of background material through use of a conventional needle member and thread connected thereto;

FIG. 8 is a view showing the liner support member of FIG. 2 having the removed applique template shown thereon in dotted lines at a space where it can be re-attached thereto for future use;

Figure 4:
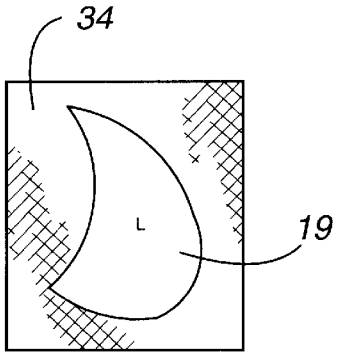
FIG. 4 is a top plan view of an applique template which has been removed from the liner support member and placed on a portion of a chosen applique material.

The following is a discussion and description of preferred specific embodiments of the applique art kit assembly and method of creating applique art of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail, and in particular to FIG. 1, an applique art kit assembly of this invention, indicated generally at 14, consists of 1) a silicone coated liner support member 16 having a plurality of pre-cut and pre-printed vinyl applique elements or templates 18 mounted thereon as by a releasable pressure sensitive adhesive; 2) an overlay clear vinyl sheet member 20 having printed thereon applique images or outlines 22; 3) a means for connecting being a box of anchor pins 24 or a fabric glue bottle 26 with glue therein and a plurality of pin members 28 contained within the box of anchor pins 24; 4) means for cutting or a pair of scissor members 30 to cut cloth material or the like as will be noted; 5) a spool of thread 29 having a needle member 31 attached to a thread 33 for reasons to be explained; 6) a yardage of chosen background material 32 normally of a cloth material; 7) a yardage of chosen applique template material 34 for creating the applique art object as will be explained; and 8) an instruction sheet 36 having instructions therein for proceeding with a step-by-step method of creating the applique art object from the applique art kit assembly 14.

The box of anchor pins 24 or fabric glue bottle 26 present a means for connecting and either could be used as that means as will be noted. A fabric glue in the glue bottle 26 is preferably of a water soluble type for ease of re-positioning in case of alignment error on the chosen yardage of background material 32.

The silicone coated liner support member 16 is clearly shown in FIG. 2 having a plurality of the pre-cut and pre-printed vinyl applique templates 18 thereon which are individually identified with respective letters from A-L printed thereon. The element "L" will also be known as applique template 19 which is to be utilized throughout the description of the method of creating the applique art object as will be explained.

Figure 10:
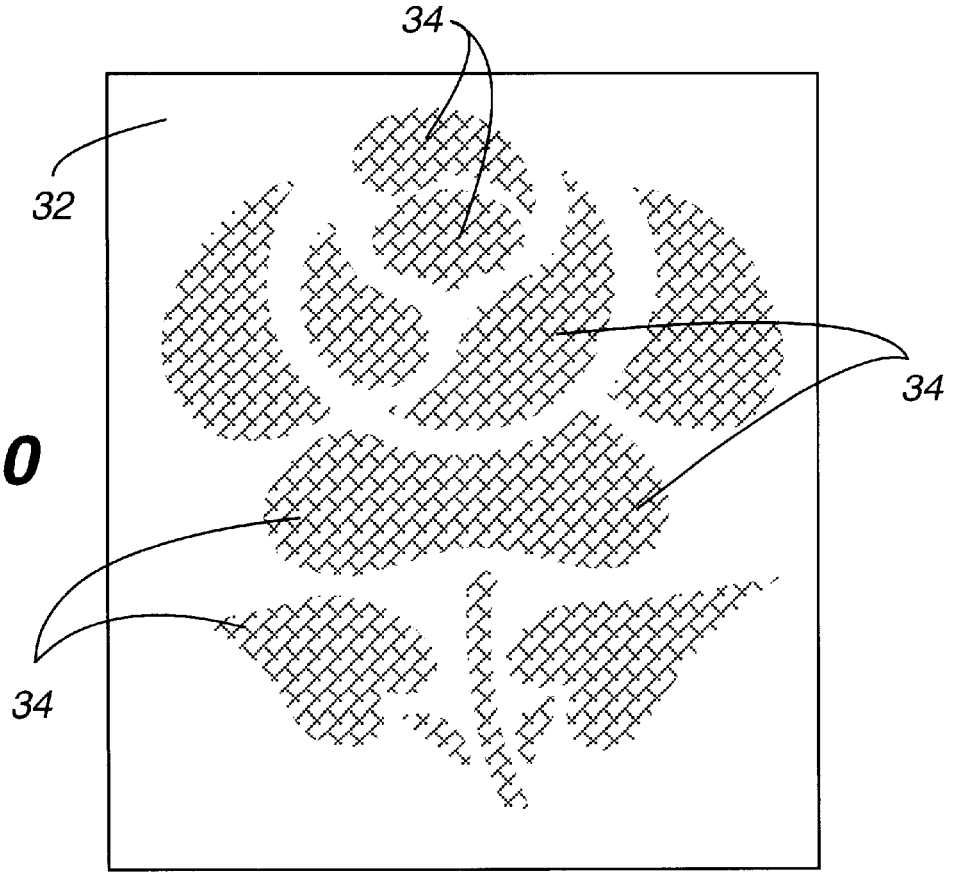
FIG. 10 is a top plan view of the completed applique art object.

On examining the outline of the various applique templates 18 as shown in FIG. 2, it is seen that collectively these represent an outline of a rose member having rose petals, stem, and leaves thereon which is more clearly shown as a final product in FIG. 10.

Figure 3:
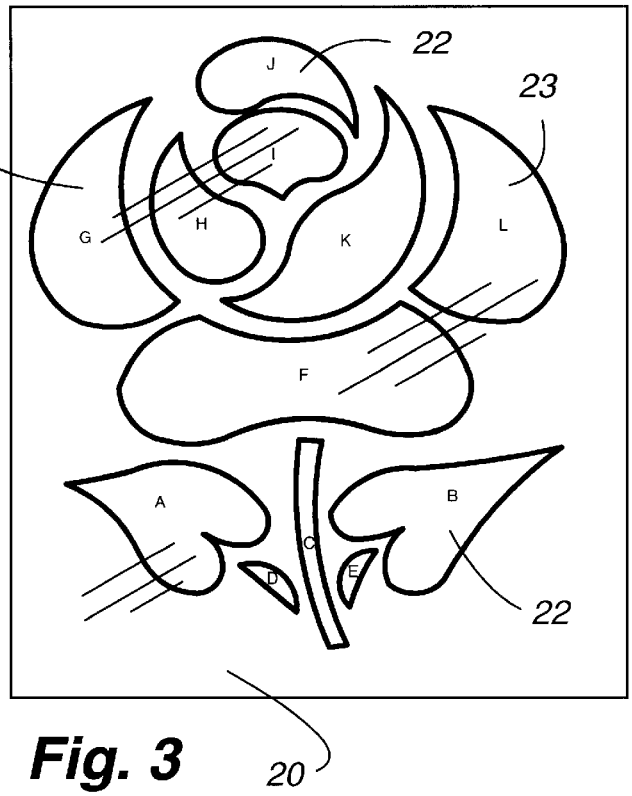
FIG. 3 is a top plan view of a clear vinyl overlay sheet member having a plurality of printed applique images or outlines thereon which are the exact shape, size, and location as indicated by the rose designer conforming to those presented on the liner support member to present the rose member outline.

FIG. 3 more clearly illustrates the overlay sheet member 20 being constructed of a clear vinyl material and having thereon the outline of the rose member thereon with the various pre-printed applique images or outlines 22 thereon which are of the exact shape, size, and location as indicated by the rose designer. This is important in accurately achieving the final product as will be clearly explained in the method of creating an applique art object.

Figure 5:
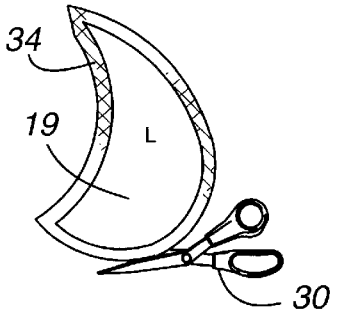
FIG. 5 is a top plan view of using a pair of scissor members to cut the applique material about the applique template at spacing approximately ¼ of an inch about an outer periphery thereof.

FIGS. 4 and 5 illustrate use of the pre-cut and pre-printed vinyl applique template 19, or member "L", being applied to the chosen applique material 34 and trimmed thereabout at a distance of ¼ of an inch by the scissor member 30.

Figure 6:
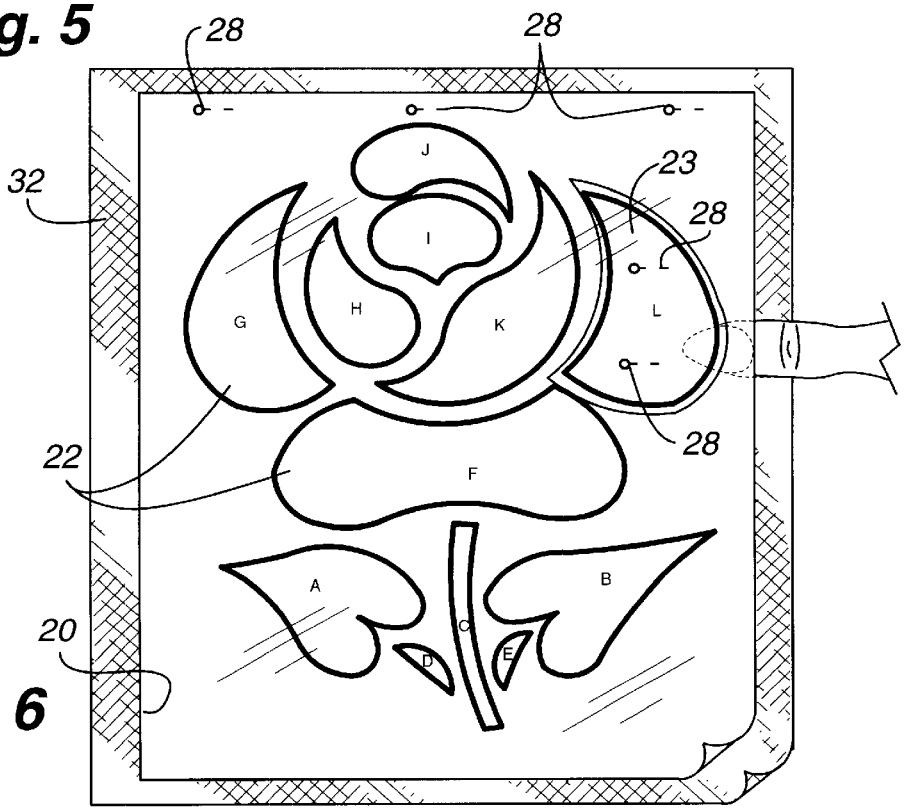
FIG. 6 is a top plan view of the overlay sheet member of FIG. 3 being attached to a chosen yardage of background material as by use of pin members and placing the trimmed element of the applique material under the clear overlay sheet member with the applique template of FIG. 5 being aligned thereto, and attached by pin members or fabric glue, to the background material.

FIG. 6 shows the overlay sheet member 20 with the applique images or outlines 22 thereon being pinned centrally to the chosen yardage of background material 32. Pre-cut and pre-printed vinyl applique template 19 applied to chosen applique material 34 is positioned under the overlay sheet member 20 aligning outline shape of 19 with corresponding shape on the clear overlay sheet member 20.

FIG. 7 shows the clear overlay sheet member 20 being raised from the yardage of chosen background material 32 and the applique template 19 attached to the chosen applique material 34, pinned/glued in place, to the chosen yardage of background material 32. The clear overlay sheet member 20 is now removed from the background material 32 and the applique material 34 is sewn in place.

FIG. 8 shows the pre-cut vinyl applique template 19 being replaced on the silicone coated liner support member 16 in its original position.

Figure 9:
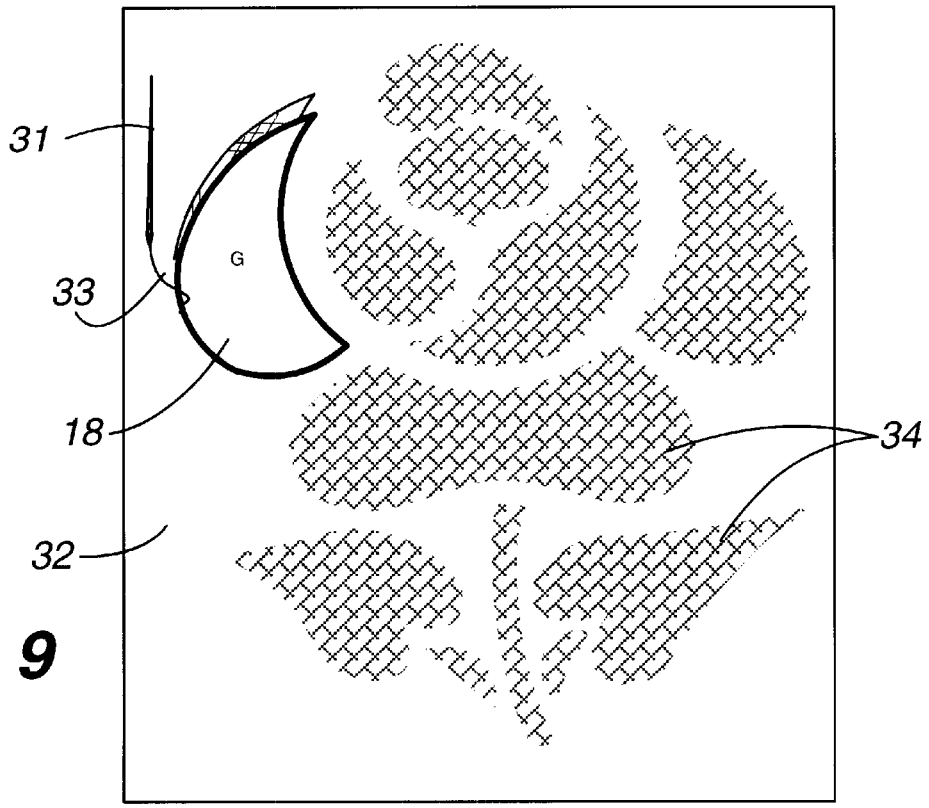
FIG. 9 is a top plan view of creating the applique art object in progress.

FIGS. 9 and 10 show a pre-cut and pre-printed vinyl applique template 18, being "G", which is the last one to be attached to the yardage of chosen background material 32. FIG. 10 shows a completed applique art object that can be put in any textile art such as quilts, clothing, or other such suitable use.

The method of creating an applique art object 12 consists of the following steps:

1. removing a pre-cut and pre-printed applique template 18 from the liner support member 16 and, more specifically, removing the pre-cut and pre-printed applique template 19 therefrom as noted as being element "L" in FIG. 2;
2. applying the removed pre-cut and pre-printed applique template 19 to the sheet of applique template material 34 which sticks thereto due to the pressure sensitive adhesive on a back side of element "L" or applique template 19 as noted in FIG. 4;
3. pressing down on the applique template 19 with hand pressure to cause the same to stick to the applique material 34 due to the pressure sensitive adhesive material on the back side thereof;
4. cutting the yardage of chosen applique material 34 about the applique template 19, leaving approximately ¼ of an inch margin of the applique material 34 thereabout as clearly shown in FIG. 5;
5. connecting, by the pin members 28, the clear vinyl overlay sheet member 20 from FIG. 3 in a centered position to an edge of the yardage of chosen background material 32 as noted in FIG. 6;
6. lifting the clear overlay sheet member 20 and slipping the applique template 19 from FIG. 5 thereunder and placing in the proper location of the image or outline "L" set forth on the overlay sheet member 20;
7. placing the applique template 19, attached to the applique material 34 thereunder, as shown in FIG. 6, and using the pin members 28 or fabric glue from the fabric glue bottle 26 for attaching same to the yardage of chosen background material 32 as noted in FIG. 6; and then removing the clear overlay sheet member 20 from the chosen background material 32.
8. turning under and sewing the chosen applique material 34 with the needle member 31 and attached thread 33 and using a desired stitching to the yardage of chosen background material 32 as noted in FIG. 7;
9. after complete sewing of the chosen applique material 34 to the yardage of chosen background material 32, removing the vinyl applique template 19 from the chosen applique material 34;
10. placing the removed applique template 19 back on the liner support member 16, as shown in FIG. 2, for possible future use; and
11. repeating the above steps 1–10 until the final applique art object is completed as noted in FIG. 10.

FIG. 9 illustrates using an applique template 18 or "G" on a piece of the chosen applique material 34 where it is the last one being sewed onto the yardage of chosen background material 34 and, when completed, the applique template 18 or "G" is then replaced to the liner support member 16 as shown in FIG. 2.

The completed applique art object is shown in FIG. 10 which can be sewn into any textile art such as quilts, clothing, or other such suitable use.

Use and Operarting of the Invention

The applique art kit assembly 14 of this invention can be provided with the numerous elements noted therein and the liner support member 16, having the pre-cut and pre-printed vinyl applique templates 18 thereon, can present various designs such as a parrot, an animal, a fish, a flower, etc. If a different outline than a rose member is provided, it would be obvious that the overlay sheet member 20 having the printed applique images or outlines 22 thereon would represent an animal, bird, parrot, fish or any desired design.

The applique art kit assembly 14 can be provided with a plurality of yardage of the chosen applique material 34 which may be of multi-color to fit with the various applique templates 18. There may be a plurality of the yardage of chosen background material 32, perhaps of various materials such as cotton, silk, or the like. The rose member design needs A and B applique elements 18 being leaves plus C the stem and small leaves D and E that would probably be of a green color needed in the applique material 34. Also, the various elements of the rose, such as elements F, L, G, and J, would be a consumer chosen color of applique material 34 to represent the proper color of the various elements of the rose member.

The method of creating applique art has been previously described in detail and it is obvious that the pre-cut and pre-printed vinyl applique templates 19 and the pre-printed applique template 23 on the clear vinyl overlay sheet member 20 will be of shapes so as to be compatible while creating the applique art object of this invention.

It is obvious that, the box of anchor pins 24 or water soluble fabric glue bottle 26 having the glue material therein, can be referred to as a means of connecting. The glue material can replace the pin members 28 if so desired during the method of creating the applique art object of this invention.

It is noted that the applique art kit assembly 14 and the method of creating applique art of this invention provides a labor saving means of creating the final applique art object, eliminating many steps presented in cited prior art patent and method of creating an applique art object.

Further, the applique art kit assembly can be presented in various designs; is easy to use; simple to follow the instructions; economical to manufacture; and, with the overlay sheet member, a means of accurately producing the final applique art object.

While the invention has been described in conjunction with preferred specific embodiments thereof, it will be understood that this description is intended to illustrate and not to limit the scope of the invention, which is defined by the following claims:

I claim:

1. An applique art kit assembly used to create an applique art object, comprising:

a) an applique template;

b) an overlay sheet member having printed thereon an applique template outline conforming in shape to said applique template;

c) a yardage of applique material operable to receive and releasably anchor said applique template thereon;

d) means for cutting said applique material about said applique template;

e) a yardage of background material operable to have said overlay sheet member mounted thereon;

f) means for connecting said applique material with said applique template thereon to said yardage of background material; and g) means to connect said applique material to said yardage of background material.

2. An applique art kit assembly as described in claim 1, including:

a) an instruction sheet having detailed step-by-step method instructions on how to create the applique art object.

3. An applique art kit assembly as described in claim 1, wherein:

a) a liner support member having a plurality of said applique templates thereon in a manner to show the applique art object to be created.

4. An applique art kit assembly as described in claim 1, wherein:

a) said overlay sheet member constructed of a clear plastic material having a plurality of said applique template outlines thereon in a manner to show the applique art object to be created in a proper position on said yardage of background material and being of a shape and size identical to a design presented by a plurality of said applique template on a liner support member.

5. An applique art kit assembly as described in claim 1, wherein:

a) said means for cutting being a conventional pair of scissors adapted to cut a cloth material; and b) said means for connecting consists of pin members and/or an adhesive, water soluble, glue substance.

6. An applique art kit assembly as described in claim 3, wherein:

a) each of said applique templates having a releasable pressure sensitive adhesive on a back surface thereof operable to releasably secure to 1) said liner support member; and 2) said applique material.

7. An applique art kit assembly as described in claim 1, wherein:

a) a plurality of said yardage of applique material provided of in different colors in order to produce the applique art object having elements of different colors.

8. An applique art kit assembly as described in claim 1, wherein:

a) a liner support member having a plurality of said applique templates thereon in a manner to show the applique art object to be created; and b) each of said applique templates are pre-cut and pre-printed with an identification indicia thereon.

9. A method of creating an appliqué art object comprising the following steps:

a) removing a pre-cut appliqué template from a support member;

b) applying said appliqué template with hand pressure to right side of an appliqué material;

c) cutting said appliqué material about an outer periphery of said appliqué template at a predetermined distance from said appliqué template;

d) connecting a clear vinyl overlay sheet member to right side of said yardage of background material having printed thereon an outline of said appliqué template being of a same size and proper location as said pre-cut applique template used to achieve the final appliqué art object;

e) positioning said appliqué template in a predetermined position on right side of a yardage of background material;

f) lifting away said clear vinyl overlay sheet member from right side of a yardage of background material; and g) securing said applique material to right side of said yardage of background material to present an element of the appliqué art object being created.

10. A method of creating an applique art object as described in claim 9, including:

a) before step a) in claim 9, holding a plurality of said applique template on said support member by a pressure sensitive adhesive coating on back sides of said applique templates.

11. A method of creating an applique art object as described in claim 9, including:

a) before step b) in claim 9, holding said pre-cut applique template to a face side of said applique material by a pressure sensitive adhesive coating on a back side of said applique template.

12. A method of creating an applique art object as described in claim 9, including:

a) after step d) in claim 9, folding under said applique material about the outer periphery of said applique template before securing as set forth in step e) in claim 9.

13. A method of creating an applique art object as described in claim 9, including:

a) during step e) of claim 9, using a needle and thread and a preferred stitch to secure said applique material to said yardage of background material.

14. A method of creating an applique art object as described in claim 9, including:

a) repeating steps a) through e) in claim 9 with other ones of said applique templates positioned in different preselected positions on said yardage of background material to achieve the final applique art object.

15. A method of creating an applique art object as described in claim 9, including:

a) in step c) of claim 9, using said predetermined distance, being a distance of 0.250 plus or minus 0.125 inches.

16. A method of creating an applique art object using a plurality of applique templates being pre-cut and pre-printed with identification indicia thereon with the applique templates of desired shapes to be attached to an applique material for attachment to a yardage of chosen fabric background material to create the applique art object, said method comprising:

a) removing a pre-cut and pre-printed applique template from a support member;

b) applying said pre-cut and pre-printed applique template to an applique template material;

c) cutting said applique material about an outer periphery of said pre-cut and pre-printed applique template at a predetermined distance from said pre-cut and pre-printed applique template;

d) mounting said pre-cut and pre-printed applique template in a predetermined position on a yardage of background material; and e) securing said applique material to said yardage of background material to present an element of the applique art object.

17. A method of creating an applique art object as described in claim 16, including:

a) before step a) in claim 16, holding a plurality of said pre-cut and pre-printed applique templates on said support member by a pressure sensitive adhesive coating on back sides of said pre-cut and pre-printed applique templates.

18. A method of creating an applique art object as described in claim 16, including:

a) before step b) in claim 16, holding said pre-cut and pre-printed applique template to said applique material by a pressure sensitive adhesive coating on a back side of said pre-cut and pre-printed applique template.

19. A method of creating an applique art object as described in claim 16, including:

a) after step d) in claim 16, turning under said applique material about the outer periphery of said pre-cut and pre-printed applique template before securing as set forth in step e) in claim 16.

20. A method of creating an applique art object as described in claim 16, including:

a) connecting a clear vinyl overlay sheet member to said yardage of background material having printed thereon an outline of said pre-cut and pre-printed applique template being of a same size and proper location as said pre-cut and pre-printed applique template used to achieve the final applique art object.

* * * * *